United States Patent [19]

Jensen

[11] 4,439,176

[45] Mar. 27, 1984

[54] APPARATUS FOR FOLDING SHEET MATERIAL, PREFERABLY LAUNDRY

[75] Inventor: Jorn M. Jensen, Bern, Switzerland

[73] Assignee: Ejnar Jensen & Son A/S, Bornholm, Denmark

[21] Appl. No.: 361,770

[22] Filed: Mar. 25, 1982

[30] Foreign Application Priority Data

Mar. 25, 1981 [DK] Denmark ..... 340/81

[51] Int. Cl.[3] ..... B65H 45/14

[52] U.S. Cl. ..... 493/419

[58] Field of Search ..... 493/419–421

[56] References Cited

U.S. PATENT DOCUMENTS 2,022,351 11/1935 Kahn ..... 493/419 X 2,740,627 4/1956 Woodward ..... 493/419 X

FOREIGN PATENT DOCUMENTS 706093 3/1954 United Kingdom ..... 493/419

*Primary Examiner*—A. J. Heinz

*Attorney, Agent, or Firm*—Russell E. Hattis

[57] ABSTRACT

Folding apparatus for folding of flexible sheets, for example pieces of flatwork, being transported on a conveyor comprising parallel belts (1) and at which conveyor one or more folding stations are arranged for folding the sheets along a folding line being perpendicular to the direction in which the sheets are transported. The conveyor has a descending section at which in each folding station a friction roller (6) driven synchroneously with the conveyor is arranged, the direction of rotation being such that the upper side of the friction roller moves in the same direction as the conveyor, and in which folding station downstream the friction roller a collecting plate (8) is arranged with fingers (7) at the leading edge, which fingers in a first position of the collecting plate is introduced between the belts of the conveyor and in a second position is arranged to press against the underside of the friction roller (6). The folding apparatus is simple in construction and reliable in operation. Folding stations which are inoperative may be passed by the flexible sheets on the conveyor.

4 Claims, 4 Drawing Figures

APPARATUS FOR FOLDING SHEET MATERIAL, PREFERABLY LAUNDRY

Figure 1:
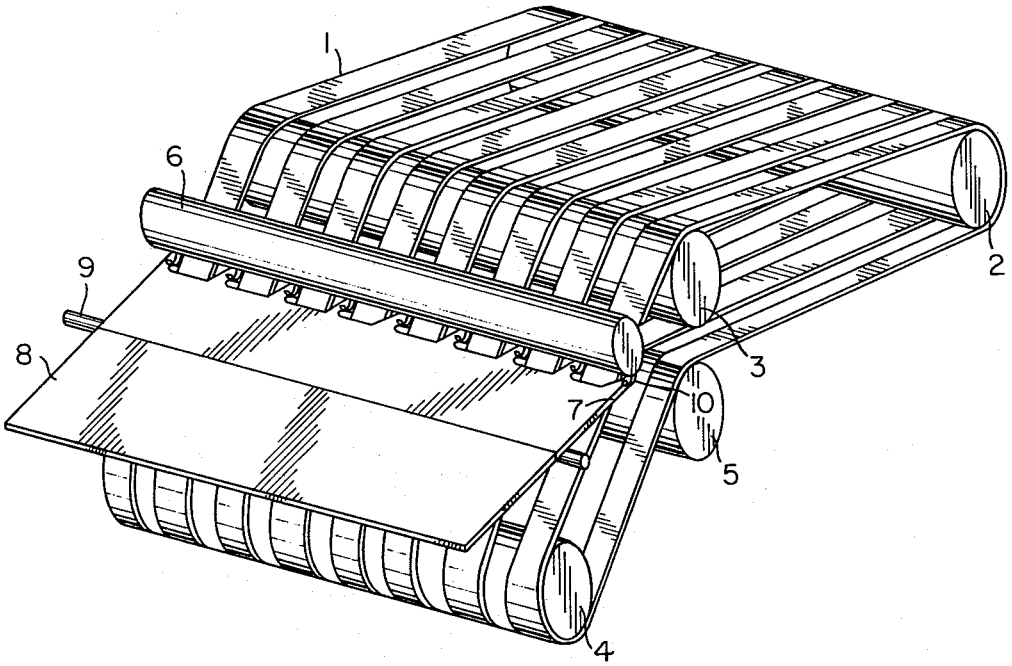

The present invention relates to an apparatus for folding flexible sheet material, for example pieces of laundry, along a folding line perpendicular to the direction in which the sheets are conveyed on a conveyor comprising a number of parallel belts, along which conveyor at least one folding station is placed comprising a plate, on which in a first position the leading edge of the sheet may be elevated from the conveyor and in a second position the sheet is clamped between the plate and a clamping means.

A folding apparatus is known, in which apparatus the leading edge of a flatwork piece is arranged to run up on an ascending ramp placed above the conveyor. In order to avoid folding the flatwork, the ramp is provided with belts driven synchroneously and in the same direction as the conveyor. When 10–20% of the length of the flatwork piece has run up on the ramp it is lifted by a lifting means against a fixed backing means clamping the flatwork piece unmovably. The further transport on the conveyor forms a loop in the flatwork piece and on releasing the ramp, a folding is made. If the loop is not able to pull the former leading edge from the ramp because of friction between the portion of the flatwork piece and the belts on the ramp, the folding will not be exact, and this is likely to happen when three-ply folds are made.

The object of the invention is to eliminate the drawbacks of the known apparatus and to simplify its construction and operation.

According to one feature of the invention this object is obtained in an apparatus of the above kind and is characterized in that the fixed backing means is replaced by a friction roller being driven synchroneously with the conveyor in such a direction that bottom of the roller moves in the opposite direction as the conveyor, and the conveyor is inclined downwardly in a forward direction below the roller. The leading edge of the sheet rides over a support plate positioned downstream of the roller and above the downwardly inclining portion of the conveyor. The lifting means is raised after a length of the leading portion of the sheet to be folded has passed by the portion of the lifting means which is to engage the same. When the lifting means presses the rear margin of this leading portion of the sheet against the friction roller, the roller then directs a portion of the sheet on the support plate in a reverse direction upon the declining portion of the conveyor below the same, thereby forming a fold at a portion of the sheet which was pressed against the friction roller by the lifting means.

In accordance with a specific feature of the invention, the support plate inclines downwardly and forwardly above the more sharply declining conveyor so that the leading edge portion of the sheet readily moves therealong prior to the beginning of a folding operation. Also, the lifting means preferably comprises spaced fingers passable between spaced belts forming the conveyor, the fingers preferably carrying rollers which idle and reduce friction between the sheet and the fingers.

If according to the invention the plate support from the first station is placed above the friction roller of the next station, the space requirement of the apparatus will not be greater than that of traditional apparatuses in spite of the fact that the total length of flatwork to be folded has to be accomodated on the support plate.

Figure 2:
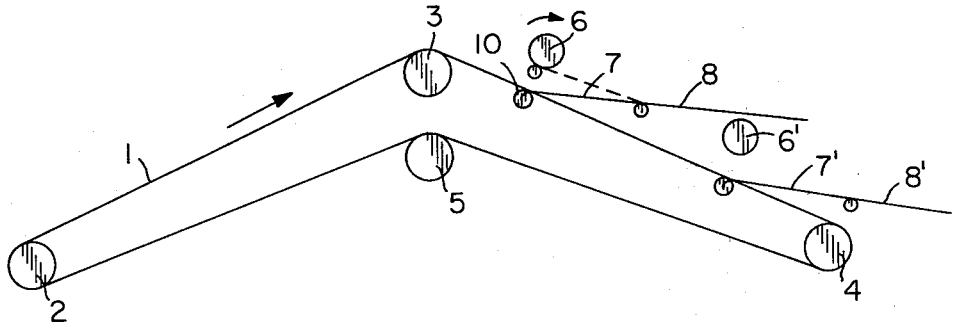
Figure 3:
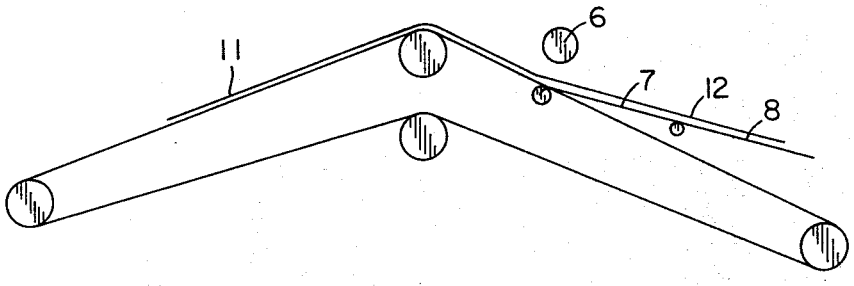
Figure 4:
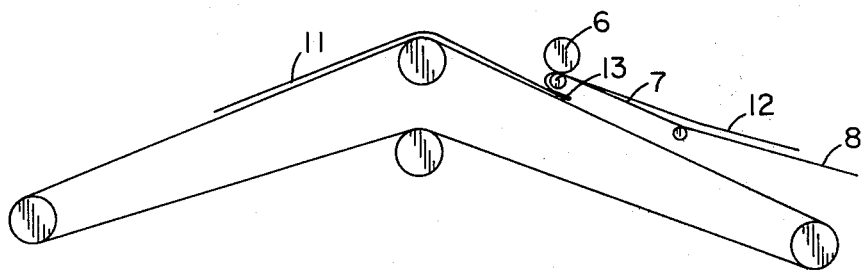

In the following the invention is described in details with reference to the drawing, in which:

FIG. 1 schematically shows the folding apparatus according to the invention with a single folding station in perspective, FIG. 2 shows a longitudinal section through the operative parts of a folding apparatus with two folding stations, and FIGS. 3 and 4 a longitudinal section through the folding apparatus showing two steps of the folding operation.

In FIG. 1, which schematically and in perspective shows the folding apparatus, a conveyor is shown comprising a number of parallel belts being supported by means of a number of rollers 2, 3, 4, and 5. The section between the rollers 2 and 3 serves as a feeding section, on which sheets, for example flatwork, to be folded are placed. Preferably, the apparatus is placed at the outlet from for, example, an ironing machine delivering dry and flattened pieces of linen to the conveyor. This section is of sufficient length to provide for a measurement of the length of the sheet to be folded, for example, by means of photocells. In practice, the section should have a length corresponding to approximately half the length of the sheets to be folded. Preferably, the roller 3 are horizontally spaced and are at the highest elevation of the folding apparatus. The next section of the apparatus between the rollers 3 and 4 is at a progressively descending elevation, which is necessary for the folding, which takes place on this section. From the roller 4 the belts return to the roller 2, with support from an intermediate roller 5, which may be arranged to act as tensioner. The conveyor is driven with such a speed that sheets or flat-work pieces placed on the section between the rollers 2 and 3 are conveyed without folds towards the section between the rollers 3 and 4, i.e. with a conveyor speed which is slightly higher than the speed with which the sheets are delivered on the conveyor.

At the section between the rollers 3 and 4 a folding station is placed. The folding station comprises a continuously driven friction roller 6 rotably mounted above the conveyor perpendicular to the transporting direction of the conveyor and driven synchroneously with the conveyor in such a way that the underside of the roller moves with the same speed as the belts of the conveyor, but in the opposite direction. Between the belts of the conveyor and below the friction roller 6 are placed some fingers 7 arranged on a support or collecting plate 8. The fingers 7 are movable, for example by moving a portion of the collecting plate 8 pivotable about a shaft 9 perpendicular to the transport direction of the conveyor from a first position shown in FIG. 1 in the drawing to a second position in which the fingers touch the underside of the friction roller 6, and in which second position a free passage is present below the fingers for sheets being transported on the conveyor. On the outer ends of the fingers are preferably placed in order to reduce the friction between the fingers and the friction roller 6.

If FIG. 2 a schematic longitudinal section through an apparatus comprising two folding stations is shown, a second friction roller 6′ being placed below the collecting plate from the first folding station. To the second folding station belongs a collecting plate 8′ with a movable portion of the plate with fingers 7′. The movable portions of the plates may be driven by means pneumatic cylinders (not shown).

The mode of operation is illustrated by means of FIGS. 3 and 4, which show a schematical longitudinal section through the folding apparatus. In FIG. 3 a piece 11 of flatwork is shown being transported on the conveyor. The fingers 7 are in said first position and the leading edge 12 of the piece of laundry has been pushed op on the collecting plate 8. In FIG. 3 the flatwork piece 11 is placed exactly with the line, along which the fold is to be made, at the ends of the fingers under the roller 6 just before the fingers are being moved to the second position in which they abut against the friction roller 6.

FIG. 4 shows the folding apparatus immediately after the moving of the fingers 7 up to the friction roller 6. Thereby, the part of the sheet or flatwork piece 11, which has been pushed up on the collecting plate 8, is driven in a direction opposite the transporting direction by the friction roller 6, whereby the sheet or flatwork piece forms a fold 13, and at the same time the portion of the sheet or flatwork piece on the plate 8 is placed on top of the remaining portion of the sheet 11 being transported on the conveyor.

In case that the number of folds required is less than the number of folding stations, one or more of these may be disabled by placing the fingers 7 in the folding station in said first position, whereby the sheet may pass freely on the conveyor under the friction roller, the fingers and the collecting plate.

The section of the conveyor between the rollers 3 and 4 should be given a descending run in order to provide also for the collecting plates a descending run.

It is possible to construct the folding apparatus with a width larger than the width of the sheets or flatwork normally folded. In this case it is preferred to divide the pivotable fingers 7 into suitable narrower sections in order to divide the apparatus into two or more narrow parallel lanes. If necessary, the sections may be coupled if very wide sheets are to be folded.

The return movement from the second to the first position may be controlled by means of a microswitch or a photocell, which is activated by the passage of the trailing edge of the sheet at the fingers 7. The folding apparatus is provided with conventional, known equipment for measurement of the length of the sheet and for circulating the placing of the folding line and for activating the folding station at the passage of the folding line.

We claim:

1. In apparatus for folding flexible sheet material, for example, pieces of laundry, along a folding line perpendicular to the direction in which the sheets are conveyed, said apparatus including conveyor means upon which the sheet to be folded is placed and conveyed thereby from an inlet station to at least one folding station, said folding station including lifting means for lifting a portion of the sheet from the conveyor means and moving it to a second position above the conveyor means where the sheet is pressed by the lifting means against a backing means, the improvement wherein said conveyor means at said folding station declines downwardly and forwardly in the direction of movement of the conveyor means; and said backing means comprising friction roller means for engaging and moving the sheet material; means for driving the friction roller means synchronously with the conveyor means so that a bottom portion of the roller means against which the sheet is pressed by said lifting means moves in a direction opposite to that of the conveyor means so as to reverse the direction of movement of the portion of the sheet material located downstream thereof, and there is provided downstream of the folding station support means above the downwardly declining portion of the conveyor means for receiving the leading portion of the sheet to be folded which has moved past said folding station, the rear margin of which is to be pressed by said lifting means against said roller means, the friction roller means when said lifting means presses the rear margin of said leading portion thereagainst reverses the direction of movement of the leading portion of the sheet to form a fold thereat and direct the portion of the sheet being folded down upon the downwardly declining portion of the conveyor.

2. The apparatus of claim 1 wherein said conveyor means comprises laterally spaced belts extending and moved in the direction in which the sheet is to be conveyed, said lifting means comprising fingers located and moved from a lowered position below the belts to a raised position above the belts in a path located between the belts.

3. The apparatus of claim 2 wherein said fingers are extensions of a support plate forming said support means.

4. The apparatus of claim 3 wherein said support plate is pivotally mounted between a first position where the fingers are in said lowered position and an operative position where the fingers press the sheet against the roller means.

* * * * *